US005518331A

United States Patent [19]

Moosmann et al.

[11] Patent Number: 5,518,331

[45] Date of Patent: May 21, 1996

[54] REFILLABLE INK PEN

[75] Inventors: Werner Moosmann; Werner Bohnert, both of Tennenbronn, Germany

[73] Assignee: Storelic AG, Switzerland

[21] Appl. No.: 215,128

[22] Filed: Mar. 18, 1994

[30] Foreign Application Priority Data

Apr. 15, 1993 [DE] Germany ..... 9305635 U
Jun. 30, 1993 [CH] Switzerland ..... 01960/93

[51] Int. Cl.[6] ..... B43K 5/08; B43K 5/10

[52] U.S. Cl. ..... 401/230; 141/20.5; 401/151

[58] Field of Search ..... 401/230, 151; 141/20.5

[56] References Cited

U.S. PATENT DOCUMENTS

| | | | |
|---|---|---|---|
| 145,102 | 12/1873 | Hamilton | 401/230 X |
| 2,130,926 | 9/1938 | Nichol . | |
| 2,603,188 | 7/1952 | McKay . | |
| 2,737,329 | 3/1956 | Bolsey . | |
| 2,894,541 | 7/1959 | Marban | 141/20.5 |
| 2,938,499 | 5/1960 | Lindenbaum . | |

FOREIGN PATENT DOCUMENTS

| | | | |
|---|---|---|---|
| 928364 | 11/1947 | France . | |
| 252969 | 12/1926 | Germany | 401/230 |
| 33630 | 8/1956 | Germany | 401/230 |
| 1020257 | 11/1957 | Germany | 401/230 |
| 8620385 | 10/1986 | Germany . | |
| 4036873 | 5/1992 | Germany . | |
| 353595 | 10/1937 | Italy | 401/230 |
| 450447 | 7/1949 | Italy | 401/230 |
| 496169 | 7/1954 | Italy | 401/230 |
| 542842 | 5/1956 | Italy | 401/230 |
| 85236 | 7/1919 | Switzerland . | |
| 255993 | 7/1948 | Switzerland . | |
| 6570 | of 1915 | United Kingdom | 401/230 |
| 611110 | 10/1948 | United Kingdom . | |

*Primary Examiner*—Steven A. Bratlie
*Attorney, Agent, or Firm*—Speckman, Pauley & Fejer

[57] ABSTRACT

A refillable pen having a writing reservoir for supplying a writing tip with ink and an additional supply reservoir for refilling the writing reservoir by operating a first valve. The additional supply reservoir is refilled from outside of the pen through a second valve by an accompanying refill container. The accompanying refill container has an injection needle with a valve and a wall of the refill container forms bellows for increasing the pressure on the liquid inside the refill container.

2 Claims, 5 Drawing Sheets

REFILLABLE INK PEN

BACKGROUND OF THE INVENTION

Field of the Invention

This invention relates to a refillable ink pen with a reservoir for supplying the writing tip with ink for writing, as well as an accompanying refill container suitably adapted for refilling the ink pen with ink. When writing, the reservoir of an ink pen is gradually emptied and the same volume of air flows into the reservoir from the outside. When this reservoir has been emptied, it can be refilled with ink or replaced with a full reservoir in the form of a cartridge. A writing tip, usually in the form of a nib, or a ball-point in the case of a ball-point pen, for example, or a felt-tip is used for writing.

Description of Prior Art

The technology of conventional writing instruments has greatly improved, but nevertheless, has some disadvantages. Writing instruments with refillable reservoirs are still relatively inconvenient to refill. The writing instrument has to be dipped by the nib or the felt-tip into ink. Then, by turning the end portion, a suction piston disposed inside the writing instrument has to be pushed forward and subsequently drawn backward by turning the end portion in the opposite direction. As this happens, a partial vacuum is created in the reservoir with respect to the atmosphere and the ink is thus sucked into the reservoir. While the end portion is being turned, which requires both hands, the nib or felt-tip must always be dipped with sufficient depth into the ink so that air cannot be sucked in. The ink is contained in a refill container, usually in a glass bottle with a screw top. When there is only a little ink remaining in the refill container, the refill operation becomes difficult because the writing tip can no longer be dipped into the refill container with sufficient depth. The refill container is then often positioned at an angle, with one side of the bottom edge of the bottle resting on a magazine, for example, so that the remaining ink runs into a corner, thereby creating a sufficient depth of liquid. Because one hand has to be used to hold the writing instrument and the other to turn the end portion, there is no hand free to hold the refill container at an angle. If no suitable elevation can be found on which to rest one edge of the container, users often resort to wedging the refill bottle at an angle between the ball of the thumb and the little finger of the hand and simultaneously holding the pen, while the other hand is used to turn the end portion. Because this is not an easy maneuver, there is a danger of spilling the contents of the bottle of ink if it slips out of the user's hand. Moreover, by using this refill procedure of sucking liquid out of a container, the nib is continually stained by the ink and has to be cleaned with a cloth after refilling. If this step is omitted, the ink may thicken on the nib and block the ink channel, the so-called ink duct. User's must therefore have a cloth or a paper handkerchief at hand. In addition, if care is not taken when cleaning, the users soon have dirty fingers from the ink. All in all, the refill process is quite a complicated, time-consuming operation which leaves something to be desired.

There are also, for example, refillable felt-tip pens or marker pens. These pens can be placed in a refill container so that the writing tip is dipped into the refill liquid. Due to the absorbency of an ink-storing tampon inside the pen, the refill ink then diffuses independently upwards into the tampon.

However, the refill process takes one to several hours. With a writing instrument having a cartridge reservoir, the operations involved in replacing the empty reservoirs are much simpler. However, the writing instrument does have to be taken apart. The used cartridge is thrown away and later has to be disposed of. It is made of plastic and disposing of it does not contribute to environmental protection. After all, many millions of these cartridges end up every year in the general household rubbish.

However, there are also writing instruments with cartridges which can be refilled from a refill bottle. This system is particularly widely used for drawing-ink pens. The transparent cartridge has to be detached from the pen and held upwards with its relatively small opening of a few millimeters diameter. The refill bottle then has to be held with the other hand and the cartridge can be refilled through a hollow needle on the refill bottle. A bubble often forms in the cartridge, which gives the erroneous impression that the refill content is greater than it actually is. To make sure, one tries to burst the bubble using the hollow needle. These are all delicate operations and so it is not unusual for drawing-ink to be spilt and fingers stained.

However, there is another problem associated with standard writing instruments with a reservoir. Their writing capacity is not very large. Therefore, the refill operation has to be carried out too often and is annoying because each time it involves an interruption. This interruption sometimes occurs at the most unsuitable moments, while a student is in the middle of a test dictation, for example, or perhaps at formal ceremonies during the signing of important documents.

Nevertheless, enlarging the reservoir to increase the writing capacity is not easily accomplished since this involves other problems. In the case of a large reservoir, a relatively big gas bubble occurs in the reservoir as it empties. The gas bubble expands if heated and exerts pressure on the ink so that more of it than is necessary runs out, causing the pen to blot. If greatly heated, ink may even leak although nothing is done to operate the pen. The same thing can happen if the pen is taken on board an airplane where the cabin pressure falls relatively quickly with respect to the pressure in the reservoir. If the pen is clipped on the inside of a jacket pocket or is carried in a ladies' handbag and it leaks for this reason, it can cause very unpleasant soiling. Pressure and temperature fluctuations are therefore always problematic and their effects become even more evident the bigger the reservoir is, and the lower the level of liquid it contains.

Another problem area is the hydrostatic pressure formed by a long reservoir. Although when the reservoir is almost empty, a very low hydrostatic pressure exists and the ink continues to flow due to the capillary action of the ink duct, in a reservoir which extends along the entire length of a pen, this pressure increases by several times. Under such pressure, the nib can no longer contain the ink and the pen blots. For this reason, a pen with a reservoir which extends along the entire length of the pen would not be capable of functioning.

SUMMARY OF THE INVENTION

In view of the problems mentioned above, it is one object of this invention to provide a refillable ink pen having a reservoir for storing the liquid used for writing which would overcome all the previously mentioned disadvantages. It is another object of this invention is to provide a pen with a greater writing capacity which is less sensitive to fluctuations in temperature and pressure or which is capable of being brought into a condition in which it is not influenced by these fluctuations, so that no ink leaks. In addition, it is another object of this invention to provide a pen with a reservoir which is simple to refill and does not require cartridges which are a burden on the environment.

These and other objects are achieved by a refillable pen in accordance with one embodiment of this invention having a writing reservoir for supplying the writing tip with liquid for writing, and an additional supply reservoir in the pen from which the writing reservoir can be refilled by operating a valve. The supply reservoir is refillable from the outside, through a valve from an accompanying refill container.

These and other objects are also achieved by a refill container in accordance with one embodiment of this invention having an injection needle with a one-way valve and a mechanism for exerting pressure on the ink within the container.

BRIEF DESCRIPTION OF THE DRAWINGS

The invention and its manner of functioning will be described below in detail with reference to the drawings, in which.

DESCRIPTION OF PREFERRED EMBODIMENTS

Figure 1:
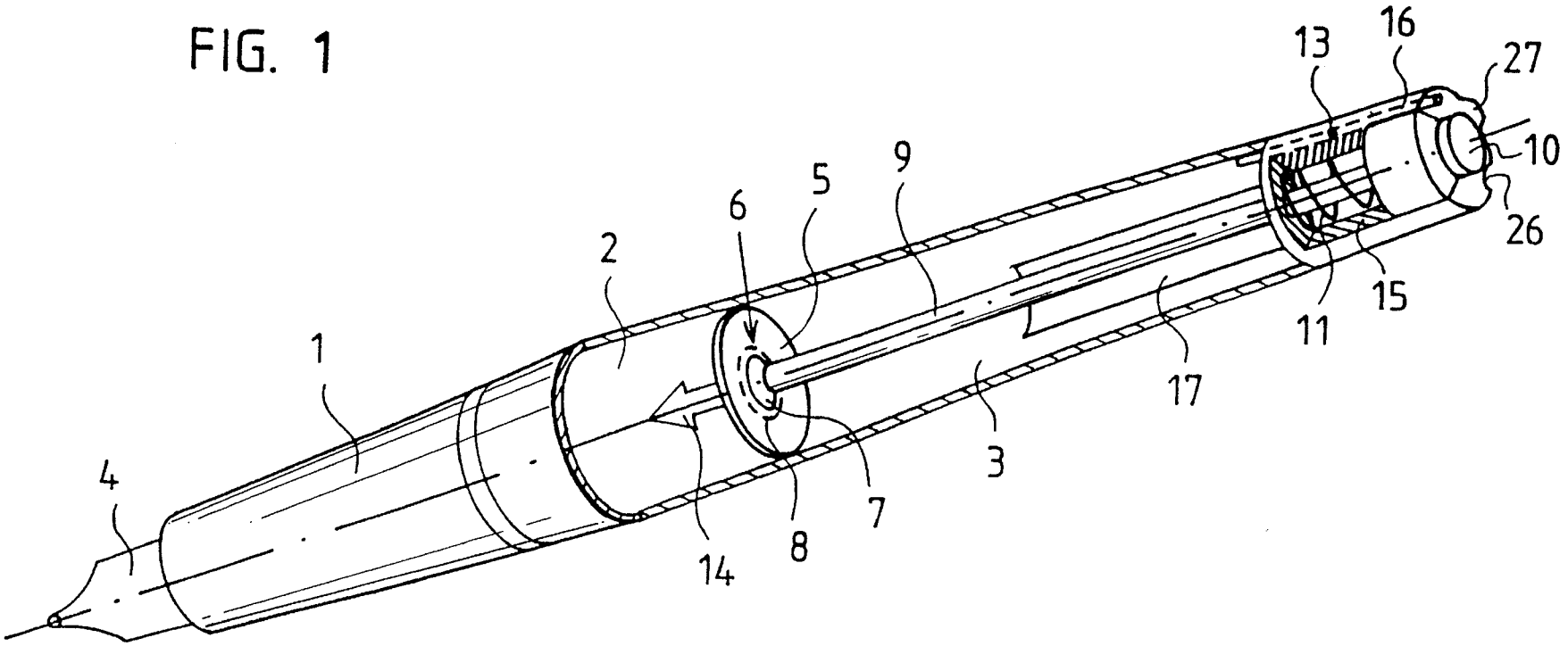
FIG. 1 is a partial cross-sectional view of a refillable pen in accordance with one embodiment of this invention.

FIG. 1 shows a partial cross-sectional view of an entire pen 1 in accordance with one embodiment of this invention. Inside the case, the pen 1 contains a writing reservoir 2. In the embodiment shown in FIG. 1, the writing tip is in the form of a nib 4 which is supplied with ink in a conventional manner from the writing reservoir 2 through an ink duct. In place of a nib, the writing tip may also be a felt-tip or a ball-point. The special feature of the pen 1 is that, in addition to the writing reservoir 2, there is a separate supply reservoir 3 in the pen 1, from which the writing reservoir 2 can be refilled by operating a first valve 6 which connects the supply reservoir 3 to the writing reservoir 2. This supply reservoir 3 can be refilled from the outside, through a second valve 13 within the pen 1, by an accompanying refill container. The pen 1 will be discussed in detail first.

In an embodiment in accordance with this invention, as shown in FIG. 1, the writing reservoir 2 is significantly smaller than the supply reservoir 3. This is intentionally done to ensure that the writing reservoir 2 is not significantly influenced by fluctuations in temperature and pressure. The fluctuations in temperature and pressure do not significantly influence the writing reservoir 2 because the air bubble which forms when the pen 1 is used due to air flowing into the writing reservoir is relatively small and therefore does not cause any problems which might lead to blotting. However, the supply reservoir 3 is provided to ensure that the pen 1 has a large writing capacity, from which .the writing reservoir 2 can be refilled by operating the valve 6 which connects the supply reservoir 3 to the writing reservoir 2. The volume of the separate supply reservoir 3 is significantly greater than the writing reservoir 2. The writing reservoir 2 can thus be refilled several times from the supply reservoir 3. To simplify the refill operation, the first valve 6, as shown in FIG. 1, takes the form of a separating wall 5 forming a central opening 8, in which a valve disk 7, which is mounted on a valve rod 9, is seated. When the valve 6 is closed, the writing reservoir 2 and the supply reservoir 3 are sealed off from one another. If the valve 6 is opened, they connect with each other and the liquid they contain can flow in both directions through the first valve 6 as required. In an even simpler embodiment of this invention, in which the inside of the supply reservoir 3 is tapered conically towards the back end of the pen 1 as in the embodiment shown in FIG. 1, the separating wall is formed by the valve disk itself, and its edge is provided with a rubber seal in the form of an O-ring, which sealingly abuts an inner surface of a reservoir wall which forms the writing reservoir 2 and the supply reservoir 3.

The first valve 6 is in both cases operated so that the valve rod 9 can be displaced towards the writing tip 4, as shown by the arrow 14. The valve disk 7 is thereby lifted from a valve face formed by an edge surrounding the central opening 8 and opens the connection between the supply reservoir 3 and the writing reservoir 2. At the rear end of the valve rod 9 there is an operating button 10. Disposed around the end of the valve rod 9 is a pressure spring 11 which is seated in a mounting 15 which is fixed with respect to the pen 1 and biases the operating button, thereby urging the valve disk 7 into a closed position. The upper end of this pressure spring 11 contacts the bottom face of the push-button 10, which then serves as the refill push-button 10. At the location where the valve rod 9 penetrates the mounting 15, the rod 9 is sealed off from the supply reservoir 3. The edge portion of the mounting 15 forms a fine hollow channel 16 for refilling the supply reservoir 3. Incorporated in this hollow channel 16 is a second valve in the form of a rubber membrane 13 which has a fine, central hole. In the relaxed state, when there is no needle in the hole, this rubber membrane 13 is tightly closed so that the channel 16 is interrupted and sealed off.

After filling the supply reservoir 3, which will be described in detail below, the writing reservoir 2 still remains empty at first. To prepare the pen 1 for writing, the refill push-button 10 is depressed, whereupon the first valve 6 between the supply reservoir 3 and the writing reservoir 2 is opened and thus the ink flows from the supply reservoir 3 into the writing reservoir 2 and fills the writing reservoir 2. It merely takes a few seconds to fill the writing reservoir 2. The push-button 10 is then released again and the first valve 6 between the writing reservoir 2 and the supply reservoir 3 closes. The pen 1 is now ready to operate. As it is used, the writing reservoir 2 is gradually emptied and the same volume of outflowing ink is replaced by inflowing air. However, because the writing reservoir 2 is relatively small, the gas bubble which occurs does not give rise to any problems, even where there are considerable fluctuations in temperature and pressure in the surrounding air. As soon as the writing reservoir 2 is empty, the refill push-button 10 is depressed briefly and the pen 1 is immediately ready for use again. If the pen 1 is taken on air journeys, the push-button 10 can be depressed, for safety's sake, with the pen 1 positioned so that the writing tip 4 is pointing upwards, whereupon the ink in the writing reservoir 2 immediately flows back into the supply reservoir 3. This ensures that nothing leaks from the nib 4 because the ink is then stored entirely and safely in the supply reservoir 3, which is tightly sealed on all sides. To ensure that there is even less chance of ink leaking, the pen 1 could also be fitted with a manually operated discharge valve to release any excess pressure which may have accumulated under extreme conditions in the nearly empty supply reservoir 3. This discharge valve could, for example, be operated by depressing the push-button 10, whereupon a discharge duct communicating with the supply reservoir 3 would pass over a discharge bore of the pen 1. When this discharge bore communicates with the discharge duct, the pressure is released. A tampon for holding back the ink can be incorporated in the discharge duct. On one side of the supply reservoir 3, the pen 1 has a transparent window 17 through which the level in the supply reservoir 3 may be noted. Since the total reservoir content of this pen 1 is much larger than that of conventional pens, its writing capacity is correspondingly greater. For a pen of standard size, the capacity achieved is three to five times that of the usual writing capacity.

Figure 2:
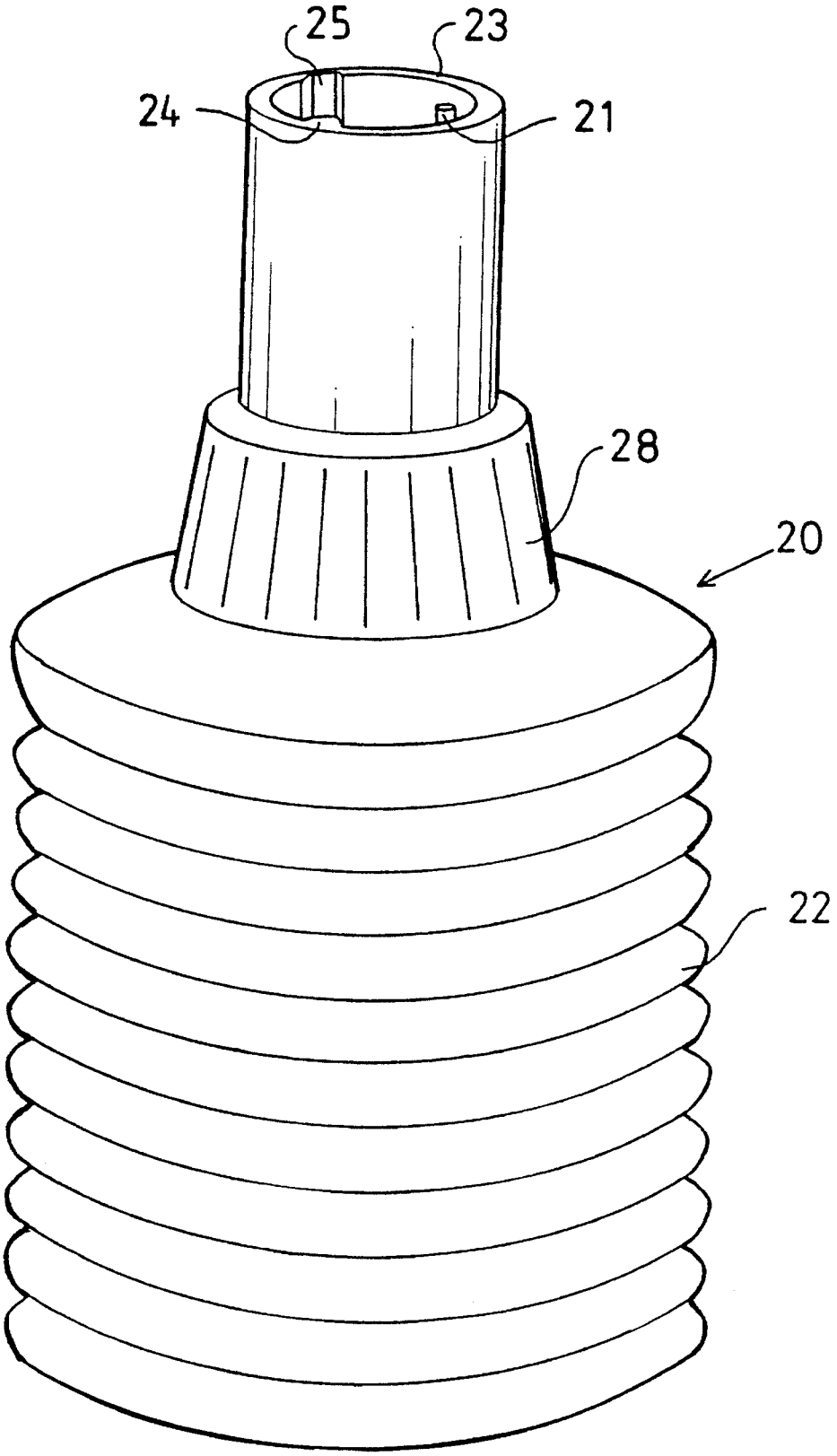
FIG. 2 is a perspective view of a refill container in accordance with one embodiment of this invention.

A special refill container 20, as shown in FIG. 2, serves to fill the supply reservoir 3. This refill container 20 has an injection needle 21 which is advantageously enclosed in a protective sleeve 23, and whose tip is encased in a retractable rubber seal. The refill container 20 also has means for exerting pressure on the ink it contains. In the embodiment shown in FIG. 2, the refill container 20 is made of plastic and forms a folding bellows 22. By compressing the bellows 22, the pressure inside is increased. The inner wall of the sleeve 23 has one or more longitudinal grooves 25 or slots 24 which fit into corresponding longitudinal slots 26 or grooves 27 formed on the end of the pen 1. The sleeve 23 also prevents, for example, students from being tempted to use the refill container 20 as a squirt gun by pulling back the rubber seal with one finger, thereby exposing the needle 21, and then pumping simultaneously, by which means the ink could of course be squirted. Due to the sleeve 23, the rubber seal which closes off the outlet of the needle 21 when not in use cannot easily be retracted, thereby preventing ink from flowing out of the refill container 20. The injection needle 21 and the sleeve 23 sit together on a screw-top lid 28 which, when removed, allows the refill container to be refilled from a larger canister. Either the refill containers themselves can be bought from a shop or the refill containers can be refilled at the shop from a larger canister. Entire canisters could also be provided to schools.

Figure 3:
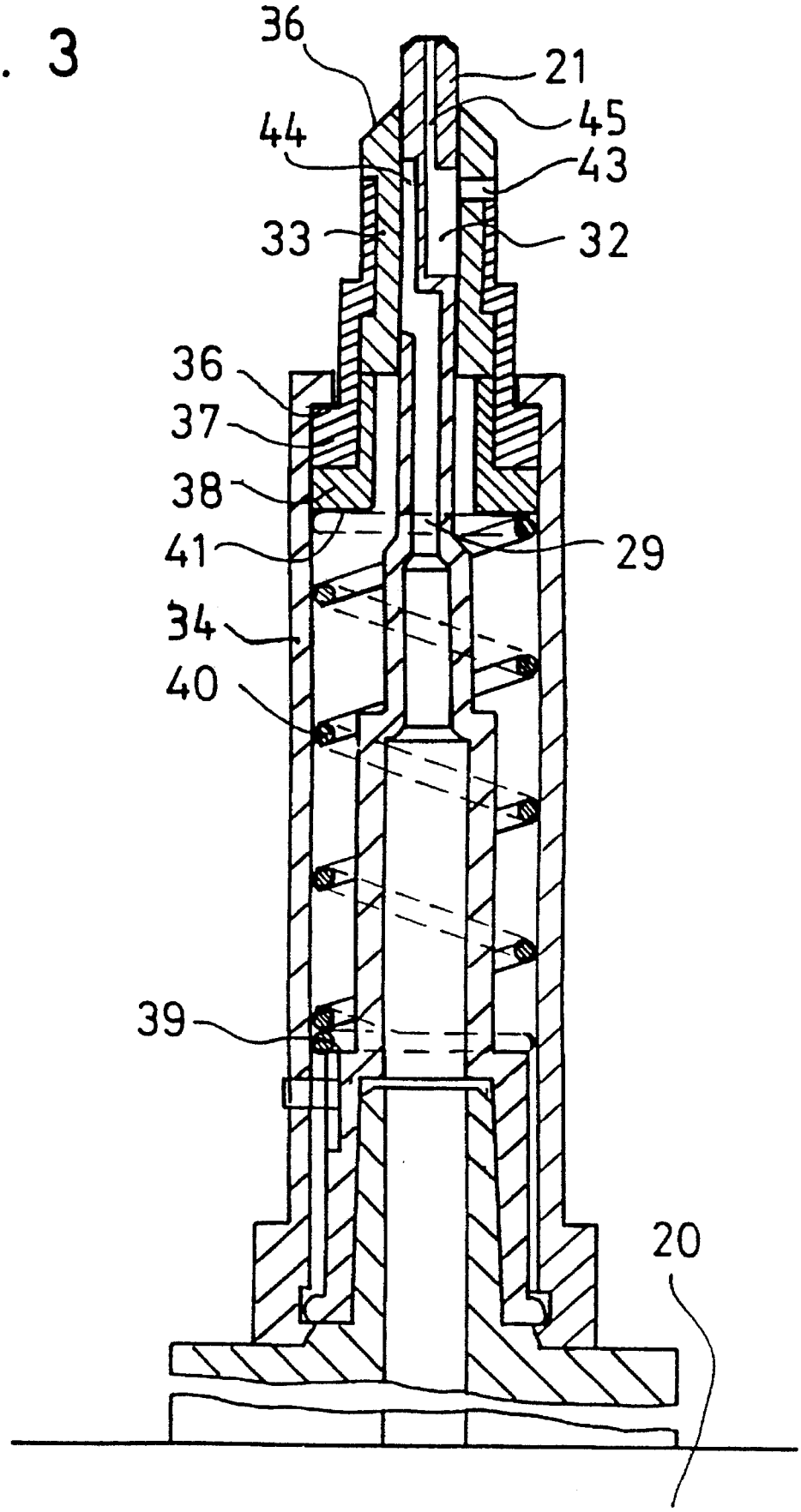
FIG. 3 is a partial cross-sectional view of an injection needle with a refill and vent bore in accordance with one embodiment of this invention.

FIG. 3 is a partial cross-sectional view of the injection needle 21 of the refill container 20. The tip of the injection needle 21 forms two separate bores. One bore 29 is for guiding the refill ink, and extends Centrally from the back of the injection needle 21 through the injection needle 21 and opens into an elongated first outlet slot 44 at the side of a front section of the injection needle 21. The ink can flow out through the first outlet slot 44 formed by the injection needle 21. A vent bore 45 extends from the seat of the needle and opens out into a second outlet slot 32 which is positioned opposite the first outlet slot 44. The vent bore 45 and the second outlet slot 32 function as a vent for air trapped in the refilled container. The entire injection needle 21 is mounted in a guide tube 34. The front edge of this guide tube 34 forms a shoulder 36 against which rests a sleeve 37 which is inserted from behind and is held in place by the shoulder 36. Located in this sleeve 37 is a rubber seal 33, against which rests a nipple 38. On one side of this rubber seal 33 there is a radial vent bore 43. The injection needle 21 extends through the central bore formed in the rubber seal 33 and has a stepped outer diameter. At the lowest step 39 there is a pressure spring 40 which at the top rests against the shoulder 41 on the nipple 38. If the needle tip is inserted into the refill channel 16 of the pen 1, the rubber seal 33 rests against the edge of the refill channel 16. If the container 20 is then pushed further in the direction of the pen 1, the injection needle 21 is pushed forward against the force of the pressure spring 40 through the rubber seal 33 and pierces the rubber membrane 13 in the refill channel 16 of the pen 1. In doing so, the rubber seal 33 is pushed back over the injection needle 21 as the sleeve 37 and the nipple 38 abutting the rubber seal 33 are pushed backwards inside the guide tube 34. The first outlet slot 44 of the injection needle 21, which is tightly sealed by the rubber seal 33 when the pressure spring 40 is in the relaxed state, is thereby exposed and ink can flow out of the container 20. The second outlet slot 32 for venting the vent bore 45, which extends from the tip of the injection needle 21 and runs radially out of the injection needle 21, simultaneously moves into position opposite the vent bore 43 in the rubber seal 33. Thus the air trapped in the supply reservoir 3 can escape through the vent bore 45 and its outlet slot 21.

Figure 4:
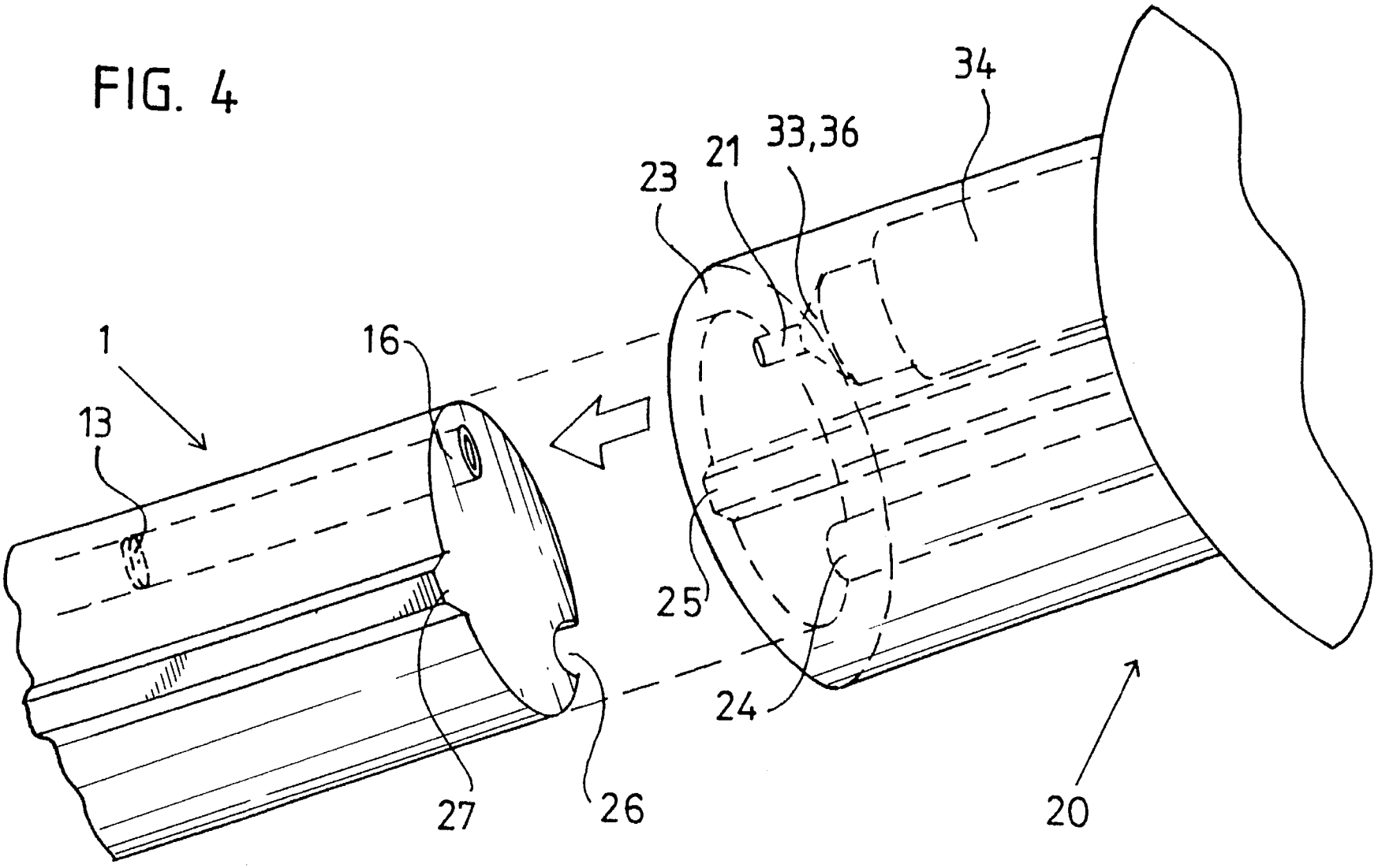
FIG. 4 is a perspective view of a portion of a refillable pen and a portion of a refill container before they are assembled for refilling in accordance with one embodiment of this invention.

FIG. 4 shows the maneuvers required for refilling. The refill container 20 is placed on the end of the pen 1 by positioning the sleeve 23 with grooves 24 or slots 25 so that they fit onto the end of the pen 1 which is also provided with slots 26 or grooves 27. When the refill container 20 and the pen 1 are pushed further together, the shoulder 36 of the rubber seal 33 in which the needle 21 is located abuts against the rim surrounding the hollow channel 16. If the refill container 20 and the pen 1 are pressed further together against the force of the pressure spring 40 in the guide tube 34, the injection needle 21 is pushed into the hollow channel 16 and pierces the rubber membrane 13 positioned within the hollow channel. Since the injection needle 21 is thereby pushed out of the rubber seal 33, a connection between the refill container 20 and the supply reservoir 3 is established. A connection between the supply reservoir 3 and the vent bore 43 in the rubber seal 33 is created simultaneously so that air can be evacuated from the supply reservoir 3 when the reservoir is refilled, thereby allowing the refill operation to proceed. To refill the reservoir 3, pressure is applied to the back of the bellows 22, whereupon the ink is discharged from the refill container 20 into the supply reservoir 3 of the pen 1. The filling operation can be observed through the transparent window 17 of the pen 1 so that the reservoir 3 is not overfilled. As soon as the filling operation is complete, the container 20 with the injection needle 21 is removed from the back end of the pen 1 and the pen 1 is again ready to write. The rubber membrane 13 closes the hollow channel 16 again and the first outlet slot 44 on the injection needle 21 is covered by the rubber seal 33.

By refilling the reservoir 3, the use of cartridges which could pollute the environment is avoided. Schools in particular attach importance to this factor.

Furthermore, the filling operation is significantly simplified and quicker to carry out, and users' fingers are no longer stained.

Figure 5:
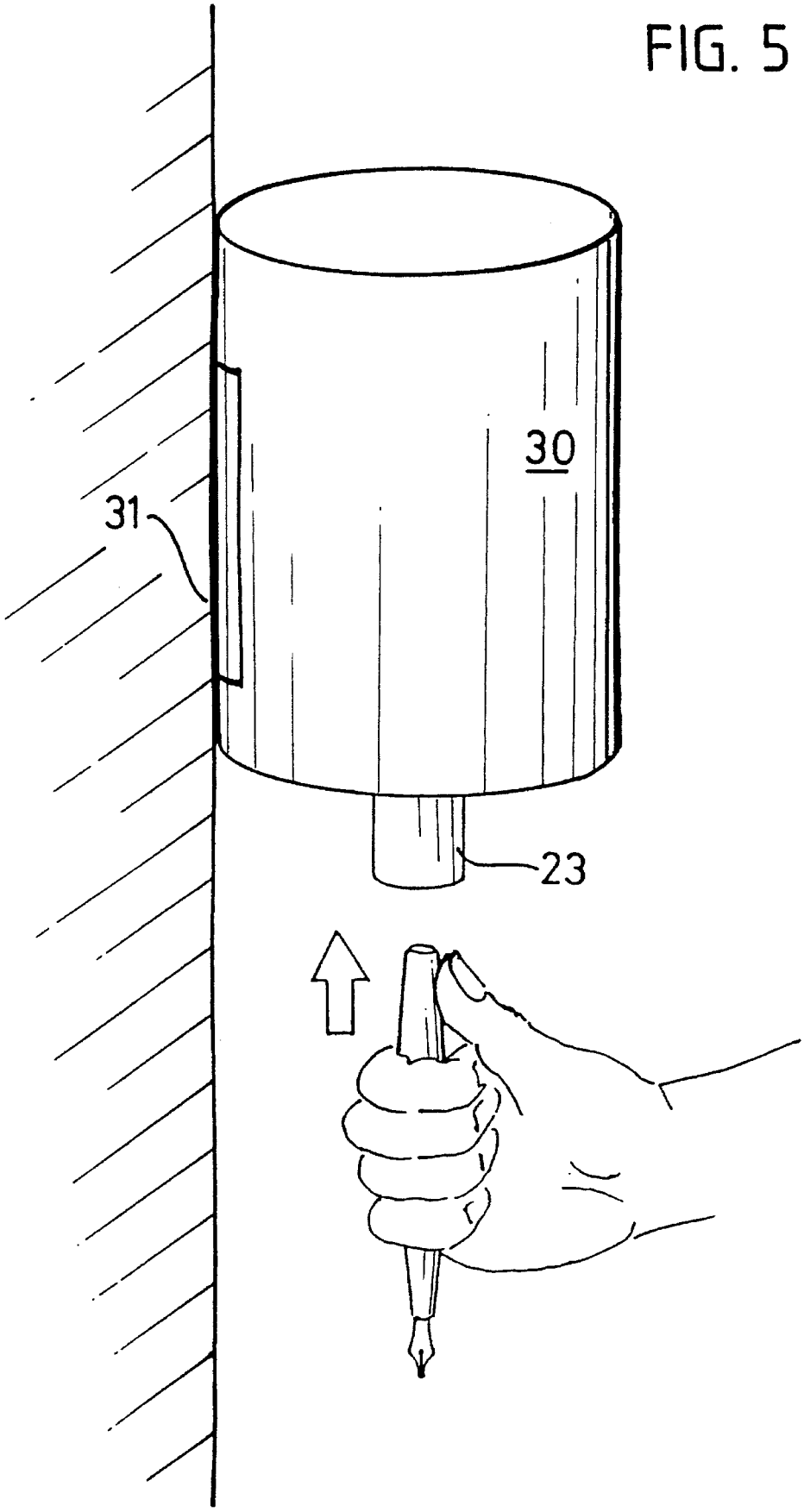
FIG. 5 is a perspective view of a collective refill container for school purposes, mounted on a wall in accordance with one embodiment of this invention.

As an alternative to an individual refill container 20, the container 20 may also be designed for a school as a collective refill container 30, which is permanently mounted somewhere in the classroom, in a cupboard, for example, or mounted on a wall 31, as illustrated in FIG. 5. For mounting the refill container 30, the refill container 30 has a special mounting device. The mounting position is such that the injection needle 21 and sleeve 23 points downwards. To increase pressure on the ink inside the refill container 30, beyond the hydrostatic pressure of the ink, in order to speed up the pen filling operation, a sealed off pressure plunger can be inserted from the outside into the inside of the container. To fill a pen, a pressure plunger may be inserted from below into the sleeve 23 and then pushed upwards until the filling operation is completed. It is then pulled downwards again.

We claim:

1. In a refillable pen with a writing reservoir for supplying the writing tip with ink, the improvement comprising: the refillable pen (1) foxing an additional supply reservoir (3) from which the writing reservoir (2) can be refilled, a first valve (6) disposed between the additional supply reservoir (3) and the writing reservoir (2) and providing a communication between said additional supply reservoir (3) and said writing reservoir (2), a second valve (13) positioned within the refillable pen (1) and providing a communication between said additional supply reservoir (3) and a refill container (20), said additional supply reservoir (3) being larger than the writing reservoir (2) and separated from the writing reservoir (2) by a separating wall (5) which forms a central opening (8), an edge surrounding the central opening (8) forming a valve face on a side of the separating wall (5) facing the writing tip (4), a valve disk (7) positioned in the central opening (8) and mounted on a valve rod (9), a push-button (10), which can be operated from an area outside of the pen (1), mounted on an end of the valve rod (9), the valve rod (9) being sealed off from the additional supply reservoir (3), and the push-button (10) biased by a pressure spring 11, Which is fixed with respect to the refillable pen (1) and urges the valve disk (7) into a closed position, the refillable pen (1) forming a hollow channel (16) at an end portion adjacent to said push button (10) extending from an outside surface of the refillable pen (1) into the additional supply reservoir (3), and the second valve, comprising a rubber membrane (13), disposed within the hollow channel (16), the rubber membrane (13) having a fine central hole which seals the hollow channel (16) when the rubber membrane (13) is in a relaxed state and accommodates an injection needle (21) of a refill container (20) when the rubber membrane (13) is in a penetrated state.

2. In a refillable pen with a writing reservoir for supplying the writing tip with ink, the improvement comprising: the refillable pen (1) forming an additional supply reservoir (3) from which the writing reservoir (2) can be refilled, a first valve (6) disposed between the additional supply reservoir (3) and the writing reservoir (2) and providing a communication between said additional supply reservoir (3) and said writing reservoir (2), a second valve (13) positioned within the refillable pen (1) and providing a communication between said additional supply reservoir (3) and a refill container (20), the additional supply reservoir (3) being larger than the writing reservoir (2) and separated from the writing reservoir (2) by a separating wall (5), the separating wall (5) comprising a valve disk (7) which sealingly abuts an inner surface of a reservoir wall which forms the writing reservoir (2) and the additional supply reservoir (3), the reservoir wall tapering conically towards a back end of the refillable pen (1), the valve disk (7) mounted on a valve rod (9), a push-button (10) mounted on one end of the valve rod (9) which can be operated from an area outside of the pen (1), the valve rod (9) sealed off from the additional supply reservoir (3), the push-button (10) being biased by a pressure spring (11), which is fixed with respect to the refillable pen (1), thereby urging the valve disk (7) into a closed position, the refillable pen (1) forming a hollow channel (16) extending from an outside surface of the refillable pen (1) into the additional supply reservoir (3), and the second valve, comprising a rubber membrane (13), disposed within the hollow channel (16), the rubber membrane (13) having a fine central hole which seals the hollow channel (16) when the rubber membrane (13) is in a relaxed state and accommodates an injection needle (21) of a refill container (20) when the rubber membrane (13) is in a penetrated state.

* * * * *